United States Patent [19]

Springs et al.

[11] 4,235,580

[45] Nov. 25, 1980

[54] NOISE SUPPRESSION STRUCTURE FOR BLOCK MAKING MACHINERY

[75] Inventors: Thomas W. Springs, Alpena; William F. Wallis, Atlanta, both of Mich.

[73] Assignee: Besser Company, Alpena, Mich.

[21] Appl. No.: 911,527

[22] Filed: Jun. 1, 1978

Related U.S. Application Data

[63] Continuation of Ser. No. 713,920, Aug. 12, 1976, abandoned.

[51] Int. Cl.[3] ..... B28B 1/08

[52] U.S. Cl. ..... 425/211; 425/413; 425/424; 425/432; 425/456

[58] Field of Search ..... 425/211, 389, 421, 424, 425/432, 456, 413; 181/207-209

[56] References Cited

U.S. PATENT DOCUMENTS

| | | | |
|---|---|---|---|
| 2,407,168 | 9/1946 | Lindkvist | 425/421 X |
| 2,831,230 | 4/1958 | Neth et al. | 425/421 |
| 3,153,834 | 10/1964 | Boyer et al. | 425/421 X |
| 3,158,089 | 11/1964 | Fillol | 425/389 X |
| 3,225,411 | 12/1965 | Rybicki | 425/424 X |
| 3,660,004 | 5/1972 | Woelk | 425/432 X |
| 3,764,242 | 10/1973 | Fischer | 425/432 X |

FOREIGN PATENT DOCUMENTS

| | | |
|---|---|---|
| 1115107 | 5/1968 | United Kingdom . |
| 1127219 | 9/1968 | United Kingdom . |
| 1413341 | 11/1975 | United Kingdom . |

*Primary Examiner*—Jan H. Silbaugh

*Attorney, Agent, or Firm*—Learman & McCulloch

[57] ABSTRACT

Apparatus for suppressing noise generated by a concrete or the like block making machine having a vibratable open bottom mold against the bottom of which the pallet is clamped to close the mold and provide a support for the molded block. The pallet support and the mold are sandwiched between yieldable, compressible, opposed force applying members which clamp the pallet to the mold and maintain the mold in a state of suspension during its vibration. The clamping of the pallet to the mold and the suspension of the mold greatly minimize noise generated by vibration of the mold.

4 Claims, 5 Drawing Figures

NOISE SUPPRESSION STRUCTURE FOR BLOCK MAKING MACHINERY

This is a continuation of application Ser. No. 713,920, filed in the United States Patent Office on Aug. 12, 1976, now abandoned.

Apparatus constructed in accordance with the invention is adapted for incorporation in a conventional concrete or the like block molding machine of the kind having a mold open at its top and bottom and into which moldable material such as concrete may be introduced. To provide a removable bottom for the mold, a pallet conventionally is supported atop a vertically movable pallet support which is carried by a vertically reciprocable frame so as to enable the pallet to be held in a position against the bottom of the mold. The conventional machine also includes a vertically movable stripper which compacts the moldable material in the mold and subsequently ejects the compacted material from the mold by moving downwardly through the mold. As the stripper moves downwardly, the pallet support also moves downwardly so as to maintain its support for the block as it is ejected from the mold.

In the manufacture of concrete and the like blocks, it is conventional practice to vibrate the mold following introduction of the moldable material thereto and prior to the ejection of the molded block. Although numerous attempts heretofore have been made to minimize noise generated as a result of the vibration of the mold, it has been exceedingly difficult to clamp the pallet sufficiently tightly against the bottom of the mold to prevent relative movement between the mold and the pallet during vibration of the mold, thereby resulting in the generation of noise above the level of that required by some statutes. Moreover, it has been difficult heretofore to prevent some lateral or sidewise relative movement between the mold and its supporting structure, thereby resulting in the generation of additional noise as a consequence of vibration of the mold.

Apparatus constructed in accordance with the invention includes a vertically movable pallet support lifting frame, a vertically movable pallet support, and a lost motion coupling between the lifting frame and the pallet support, thereby enabling movement of the lifting frame and the pallet support relative to one another and relative to other components of the machine. The apparatus also includes a lost motion coupling between the mold and its supporting structure to enable the mold and the pallet support to move as an integral unit during vibration of the mold. Each lost motion coupling includes yieldable, compressible, force applying means, the two force applying means acting in opposition to one another so as to clamp the mold and the pallet support tightly against one another and provide a cushioned, floating suspension for the mold and pallet frame during vibration of the mold so as to minimize greatly noise generated as a result of mold vibration.

An object of this invention is to provide a yieldable suspension for a vibratable mold of a block making machine to prevent engagement of the mold during its vibration with the machine frame, thereby avoiding generation of noise due to movement of the mold during vibrations.

Another object of the invention is to provide for the application of sufficient force between a pallet support and the mold to preclude relative movement of the mold and a pallet during vibration of the mold, thereby avoiding generation of noise due to relative movement between the mold and the pallet during vibration.

Other objects and advantages of the invention will be pointed out specifically or will become apparent from the following description when it is considered in conjunction with the appended claims and the accompanying drawings, wherein:

Figure 2:
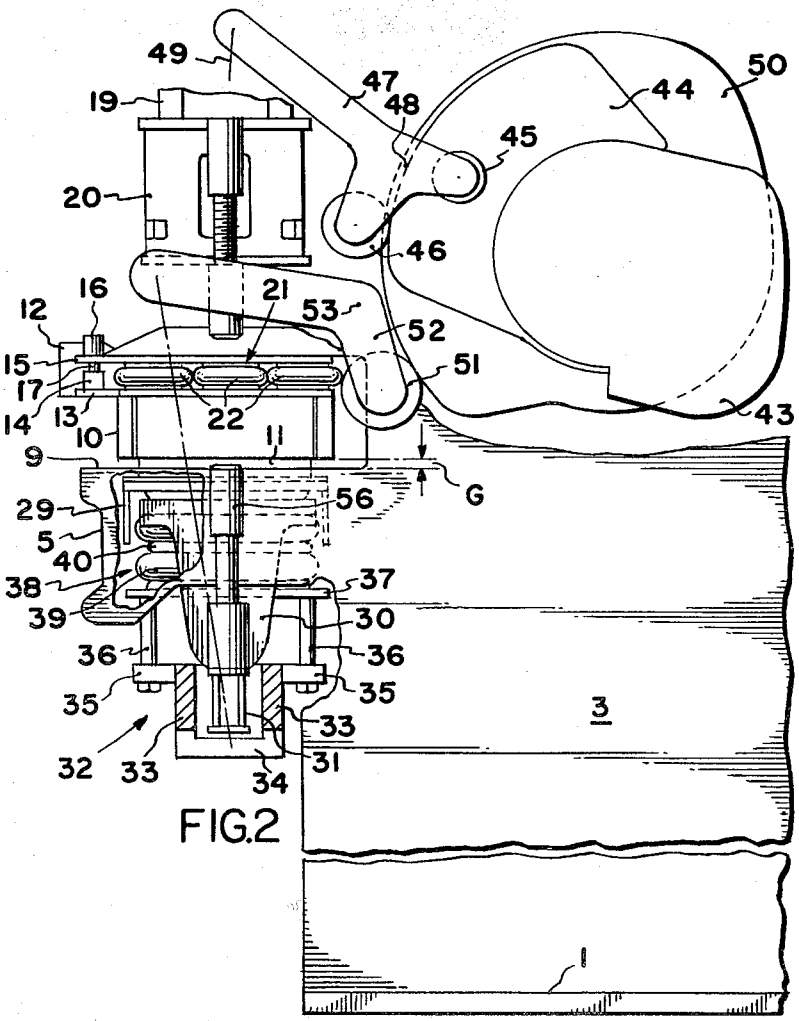
FIG. 2 is a diagrammatic, side elevational view, partly in section, the section being taken along the line 2—2 of FIG. 1.

Apparatus constructed in accordance with the invention is adapted for use in conjunction with an otherwise conventional concrete block making machine having a base 1 provided with an upstanding frame, including spaced apart frame members 2 and 3 having between their upper and lower ends forwardly projecting arms 4 and 5, respectively. The frame members 2 and 3 are notched to provide throats 6 and 7 having flat, horizontal, support surfaces 8 and 9. Spanning the throats and supported upon the surfaces 8 and 9 when at rest is a mold frame 10 on which is supported a mold member 11 having an open top and an open bottom. The interior of the mold is shaped to correspond to the block (or plurality of blocks) of the kind to be molded. A shroud 12 is carried by the member 10 and surrounds the open top of the mold 11 as is conventional.

At opposite ends of the mold frame 10 are secured a pair of fore and aft extending base or lower plates 13. At the forward end of each plate is fixed a bushing 14. Parallel to, but spaced above each plate 13, is a corresponding upper plate 15 at the forward end of each of which is fixed a block 16 from which depends a guide pin 17 which is snugly, but slideably, accommodated in its companion bushing 14.

The upper plates 15 are secured to the lower ends of vertical supports 18 which constitute parts of the machine frame and form slideable guides for a stripper frame 19 which is vertically reciprocable by means yet to be described. The frame 19 supports a stripper heat 20 which is of such size and shape as to fit snugly, but slideably, within the mold 11.

The mold frame 10, as stated earlier, normally rests upon the surfaces 8 and 9 of the throats 6 and 7, but the mold frame is capable of vertical movement and is guided in such movement by the guide pins 17. Upward movement of the mold frame relative to the stripper frame is opposed by yieldably compressible force applying means 21 comprising a plurality of gas filled, expansible and contractile bags 22 interposed between the lower and upper plates 14 and 15, respectively. The extent to which the mold frame 10 can move upward relative to the stripper frame is determined by the compressibility of the bags 22 and by the upward force applied to frame 10. For purposes of the invention, it is sufficient if the mold frame 10 is capable of movement toward the stripper frame a distance of about $\frac{3}{4}$ inch so as to provide gap G (see FIG. 2) of about $\frac{3}{4}$ inch between the throat surfaces 8 and 9 and the bottom of the frame 10.

Figure 1:
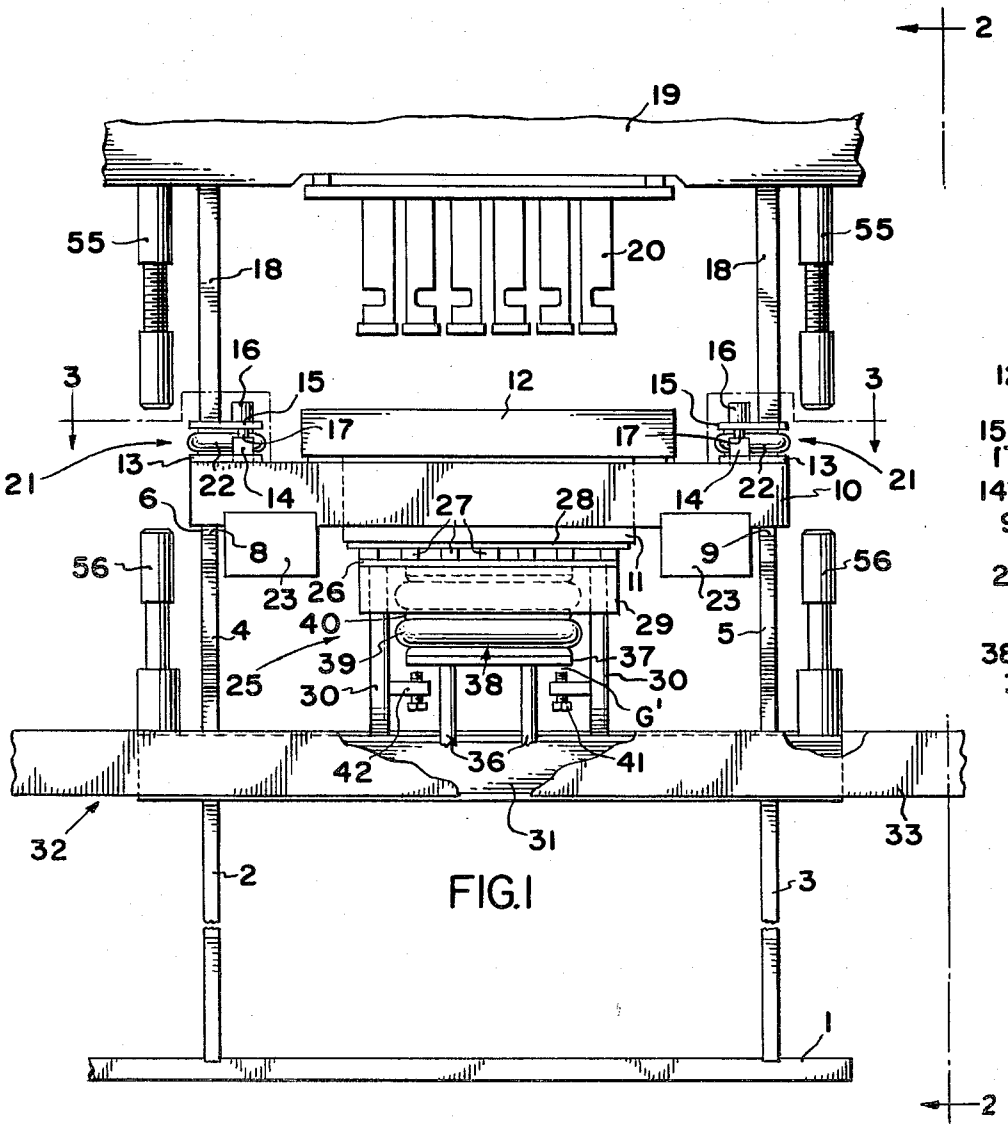
FIG. 1 is a fragmentary, front elevational view of a typical concrete blocking making machine fitted with apparatus constructed in accordance with the invention, certain parts being broken away for clarity.
Figure 3:
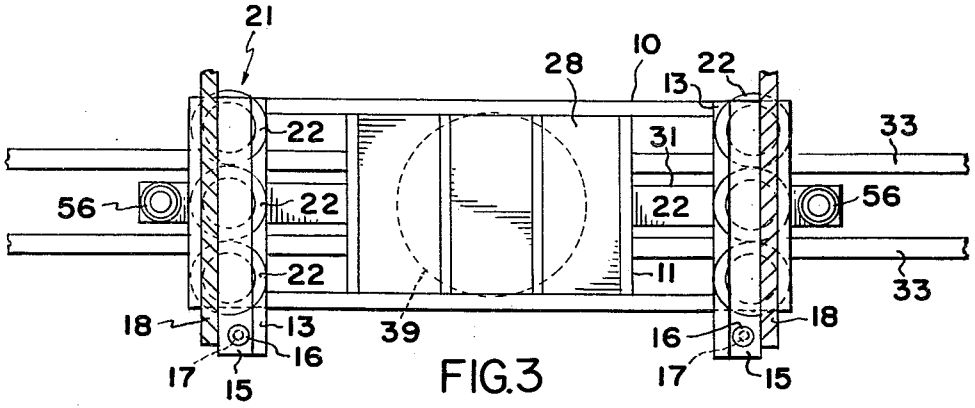
FIG. 3 is a horizontal sectional view taken along the line 3—3 of FIG. 1.

As is conventional, the mold frame 10 is fitted with motor driven vibrators, diagrammatically shown at 23 in FIGS. 1 and 3, for the purpose of vibrating the frame 10 and the mold 11. The vertical amplitude of vibrating movement of the mold frame should be less than the height of the gap G ao as to avoid engagement between the frame 10 and the throat surfaces 8 and 9 during vibration of the frame.

As is conventional, the molding machine includes a pallet support 25 comprising an upper plate 26 fitted with rubbery pads 27 atop which a metal pallet 28 may be supported to form a removable bottom for the mold 11. The upper plate 26 has a depending skirt 29 within which is accommodated the upper ends of a pair of downwardly tapering support arms 30. The upper ends of the arms are fixed to the plate 26 and the lower ends of the arms are welded to a transverse beam 31 which spans the frame members 2 and 3 at the front of the machine. The arms 30 and the beam 31 thus are movable vertically as a unit in a manner and for a purpose presently to be explained.

Figure 4:
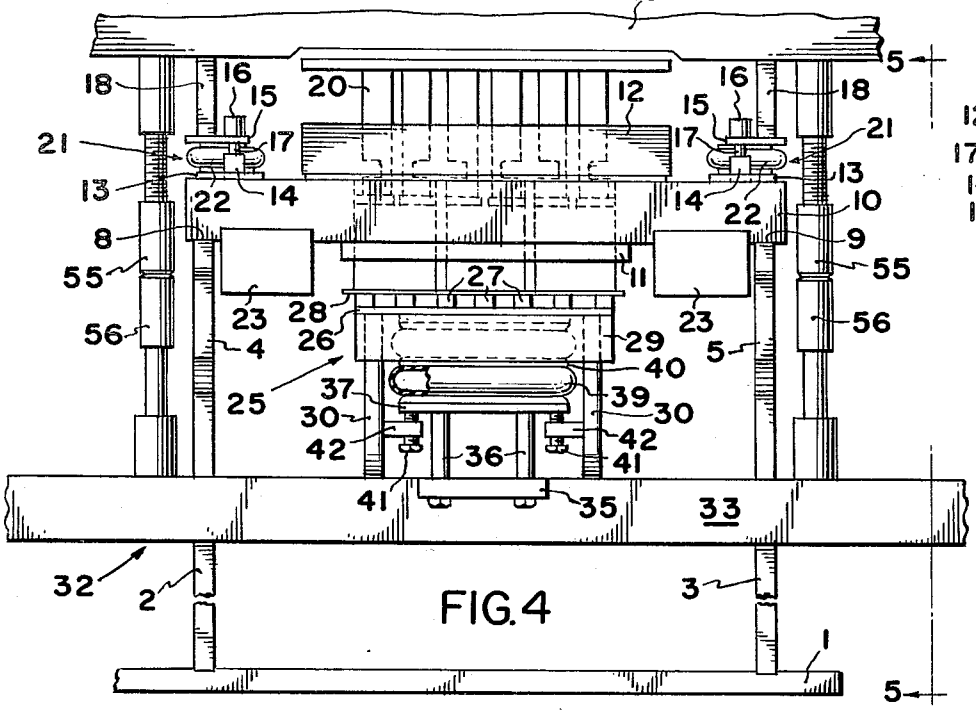
FIG. 4 is a view similar to FIG. 1, but illustrating parts of the apparatus in adjusted positions.

Straddling the beam 31 is a pallet support lifter frame 32 constituting motion transmitting means for the beam 31 and its associated structure. The lifter frame comprises a pair of spaced apart members 33 joined at their ends by cross members 34 (see FIGS. 2 and 4). Each member 33 has fixed thereto a bar 35 to which is anchored the lower ends of a pair of struts 36, the upper ends of which are fixed to a horizontal pressure plate 37. The construction is such that the lifter frame 32 and the pressure plate 37 are vertically movable as a unit.

Fitted atop the pressure plate 37 is yieldably compressible force applying means 38 comprising a gas filled, expansible and contractile bag 39 encircled at its center by a ring 40. The bag bears at its upper end against the bottom of the pallet support plate 26. The bag 39 thus constitutes the support for the transverse beam 31 and, since the bag is compressible, it forms a lost motion coupling between the lifter frame 32 and the pallet support 25 which enables relative vertical movement therebetween.

Relative movement between the beam 31 and the lifter frame 32 results in relative movement between the pallet support 25 and the pressure plate 37. The extent of downward movement of the pressure plate 37 relative to the pallet support 25 may be regulated by means of a plurality of adjustable positioning screws, two of which are shown at 41 in FIGS. 1 and 4, which are threadedly mounted in lugs 42 carried by the support arms 30. The screws 41 are adjustable for the purpose of ensuring a parallel relation between the plane of the mold 11 and the plane of the pallet support plate 26 when the gap G has been eliminated.

Figure 5:
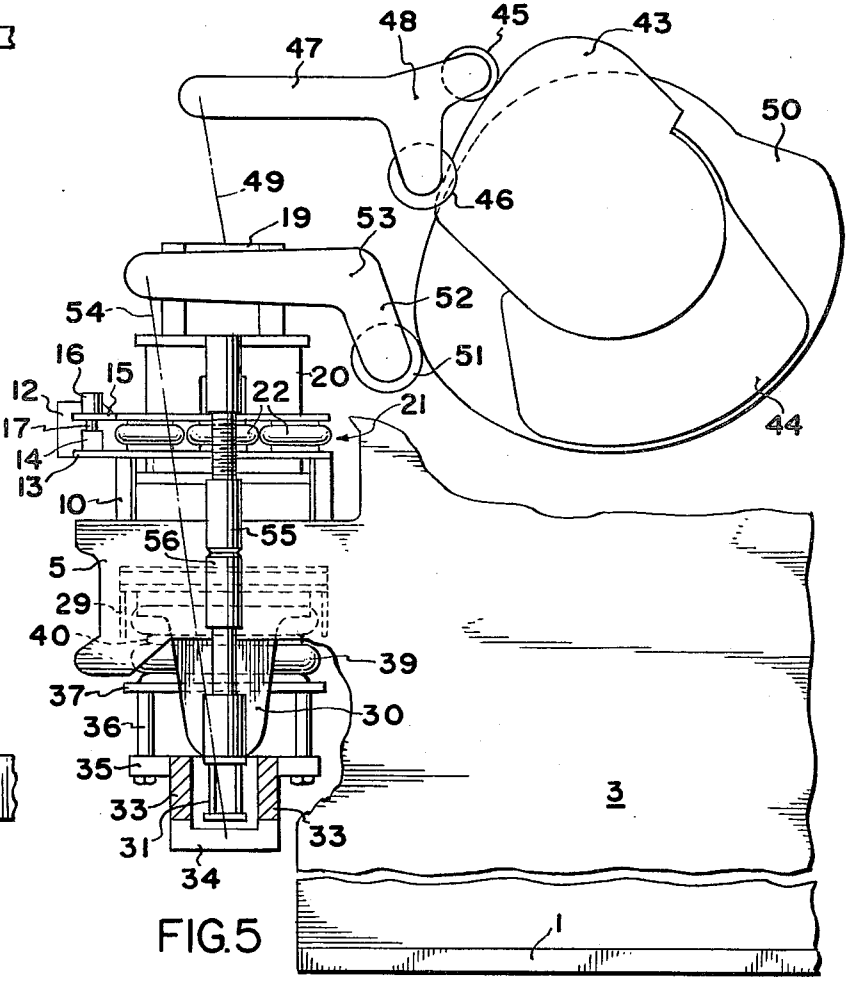
FIG. 5 is a view similar to FIG. 2, but taken along the line 5—5 of FIG. 4.

The vertical movements of the stripper frame 19 and the pallet lifter frame 32 are effected by cam controlled conventional drive means illustrated diagrammatically in FIGS. 2 and 5. The drive means for the stripper frame comprises a pair of motor driven cams 43 and 44 which are engageable and disengageable with a pair of followers 45 and 46, respectively, journaled at one end of a bell crank 47 that is pivoted as at 48 to the machine frame. The opposite end of the crank is pivotally connected by linkage 49 to the stripper frame 19 to effect vertical movements of the latter according to the contour of the cams.

The drive means for the pallet lifter frame 32 comprises a motor driven cam 50 in engagement with a follower 51 journaled at one end of a bell crank 52 that is pivoted to the machine frame at 53. The opposite end of the crank 52 is connected by the linkage 54 to the lifter frame cross members 34. The contours of the cams are so related to one another as to effect precise conjoint and relative movement of the stripper frame 19 and the lifter frame 32 for a purpose to be explained.

As is conventional, the stripper frame 19 and the lifter frame 32 are provided with confronting pairs of adjustable stops 55 and 56 operable to limit relative movement of such frames toward one another for the purpose of controlling the height of the block formed in the mold 11.

When the machine is conditioned for the molding of a block, the parts will occupy the positions illustrated in FIGS. 1 and 2 in which the stripper frame 19 is elevated to permit moldable material to be introduced to the mold 11. A pallet 28 will be supported on the pallet support 25 and will engage the bottom of the mold 11 to form a removable bottom for the latter. The lifter frame 32 also will be in an elevated position, thereby holding the pressure plate 37 at a level above that of the positioning screws 41.

Movement of the pressure plate 37 off the screws 41 causes an upward force to be applied by the bag 39 to the pallet support 25 so as to cause the plate 26 to clamp the pallet 28 tightly against the mold 11 and lift the mold frame 10 upwardly off the throat surfaces 8 and 9 to form the gap G. The upward movement of the mold frame 10 causes the lower plates 13 to move upwardly relative to the fixed plates 15, thereby effecting compression of the gas filled bags 22. The bags 22 thus apply a compressive force on the mold frame 10 in opposition to the force applied by the bag 39, and the gas content of the respective bags is so selected that the opposing forces are equal, whereby the mold frame 10 is yieldably suspended between the throat surface 8 and 9 and the upper plate 15.

The upward movement of the pallet support 25 causes corresponding movement of the beam 31 and of the positioning screws 41, but such movement is insufficient to effect reengagement of the screws with the pressure plate 37 because of the opposition force applied on the pallet support 25 via the members 22. There thus will be provided a gap G′ between the pressure plate 37 and the screws 41 and the height of such gap should be greater than the amplitude of vertical movement of the mold during the vibration.

During the filling of the mold, the clamping of the pallet 28 to the bottom of the mold, and the lifting of the mold off the throats, the vibrators 23 are operated to vibrate the mold frame, thereby effecting even distribution and compaction of the moldable material throughout the mold.

During the vibration of the mold frame the stripper frame 19 is lowered by its drive means so as to cause the stripper head 20 to enter the mold 11 to the level permitted by the stop members 55 and 56. Upon engagement of the stop members 55 and 56 vibration of the mold is discontinued, as is conventional.

In conventional block molding machinery, it is customary to strip the molded block from the mold immediately following termination of vibration of the mold by effecting simultaneous downward movement of the stripper head and the pallet support a distance sufficient to enable the molded block to be pushed through the mold to a level below that of the bottom of the mold. Molded blocks are stripped from the mold 11 of the present construction by movement of the stripper head through the mold, but the force exerted on the pallet support 25 by the bag 39 must be relieved shortly after the application of stripping force on the molded block from the mold to avoid crumbling of the block. The desired result is achieved by lowering the mold frame 10 to eliminate the gap G, thereby relocating the mold frame on the throat surfaces 8 and 9, and by simultaneously eliminating the gap G′ between the pressure plate 37 and the screws 41.

Closing of the gaps G and G′ is effected by the driving mechanisms for the stripper frame 19 and the pallet lifter frame 32. The cams 43 and 44 for controlling the movements of the stripper frame 19 are so contoured that the stripper frame is lowered relatively to the lifter frame 32 to a level in which the cooperable stops 55 and 56 engage one another, as stated previously. During such movement of the stripper frame the pallet lifter frame 32 remains stationary. The stripper frame driving cam 43 and lifter frame driving cam 50 are so contoured, however, that, following engagement of the cooperable stop members 55 and 56, the stripper frame 19 and the lifter frame 32 commence downward movement to free the molded block in the mold. Thereafter the cams 43 and 50 drive the stripping frame 19 and the lifter frame 32 downwardly and at the same speed, thereby maintaining the relative positions of the stripper frame 19 and the lifter frame 32, but effecting lowering of the mold member 10 into seating engagement on the throat surfaces 8 and 9, so as to eliminate the gap G. Downward movement of the lifter frame 32 will cause the pressure plate 37 to seat on the positioning screws 41, thereby eliminating the gap G′.

Following engagement of the pressure plate 37 with the positioning screws 41, further rotation of the cam 50 effects further downward movement of the lifter frame 32 and such movement of the lifter frame is transmitted to the beam 31 via the pressure plate 37 and the screws 41 so as to effect simultaneous downward movement of the pallet support 25. Thereafter, the stripper frame 19 and the lifter frame 32 continue to move downardly at the same rate of speed so as to enable the molded block to be pushed downwardly through the mold 11 and ejected from the latter. During the ejection of the molded block from the mold 11, the bag 39 is maintained in a compressed state, but the engagement between the pressure plate 37 and the screws 41 prevents upward movement of the pallet support 25 relative to the lifter frame. As a consequence, the pallet support 25 does not exert any force on the block being stripped from the mold 11.

The disclosed embodiment is representative of a presently preferred form of the invention, but is intended to be illustrative rather than definitive thereof. The invention is defined in the claims.

We claim:

1. In a concrete block making machinery of the kind having a frame, a vibratable, open bottom mold supported on and in contact with said frame, a pallet support beneath said mold, a pallet carried thereon, motion transmission means coupled to said pallet support for raising the latter toward said mold a distance sufficient to seat a pallet against the bottom of said mold and to raise said mold to a position spaced from said frame, and vibration causing means coupled to said mold, the improvement comprising:

first elastic yieldable means incorporated between said pallet and motion transmission means to isolate the vibration causing means, mold and pallet therefrom when the mold is vibrated;

second elastic yieldable means interacting between said mold and frame to yieldingly oppose raising movement of said mold and to isolate the mold and vibration causing means from the frame when the mold is in raised position, but enabling movement of said mold to its raised position off the frame; and drive means operable to control said motion transmission means to raise the mold and permit the second elastic yieldable means to aid in returning said mold to engagement with said frame.

2. The machinery set forth in claim 1 in which said drive means includes a rotatable cam and said motion transmission means includes a cam follower and link mechanism.

3. The machinery set forth in claim 1 in which said second elastic yieldable means comprises gas-filled bags.

4. The machinery set forth in claim 3 in which the first elastic yieldable means includes a gas-filled bag assembly.

* * * * *